US010418049B2

(12) United States Patent
Toriumi

(10) Patent No.: US 10,418,049 B2
(45) Date of Patent: Sep. 17, 2019

(54) AUDIO PROCESSING APPARATUS AND CONTROL METHOD THEREOF

(71) Applicant: CANON KABUSHIKI KAISHA, Tokyo (JP)

(72) Inventor: Yusuke Toriumi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/058,268

(22) Filed: Aug. 8, 2018

(65) Prior Publication Data

US 2019/0057711 A1 Feb. 21, 2019

(30) Foreign Application Priority Data

Aug. 17, 2017 (JP) ..... 2017-157616
Aug. 17, 2017 (JP) ..... 2017-157617

(51) Int. Cl.

| | |
|---|---|
| ***H04R 3/00*** | (2006.01) |
| ***G10L 21/0232*** | (2013.01) |
| ***H04R 1/40*** | (2006.01) |
| ***H04R 5/04*** | (2006.01) |
| ***H04R 5/027*** | (2006.01) |
| ***G10L 21/0208*** | (2013.01) |
| *G10L 21/0216* | (2013.01) |

(52) U.S. Cl.

CPC ..... *G10L 21/0232* (2013.01); *G10L 21/0208* (2013.01); *H04R 1/406* (2013.01); *H04R 3/005* (2013.01); *H04R 5/027* (2013.01); *H04R 5/04* (2013.01); *G10L 2021/02165* (2013.01); *H04R 2410/01* (2013.01); *H04R 2499/11* (2013.01)

(58) Field of Classification Search

CPC ..... G10L 21/0232; G10L 21/0208; G10L 2021/02165; H04R 1/406; H04R 3/005; H04R 5/027; H04R 5/04; H04R 2410/01; H04R 2499/11

USPC ..... 381/13, 26, 23.1, 317, 71.2, 71.8, 71.11, 381/71.12, 92, 93, 94.1, 94.7, 95, 96, 122

See application file for complete search history.

(56) References Cited

U.S. PATENT DOCUMENTS

2003/0147538 A1* 8/2003 Elko ..... H04R 3/005 381/92
2005/0175187 A1* 8/2005 Wright ..... G10K 11/178 381/71.12

FOREIGN PATENT DOCUMENTS

JP 2011-114465 * 6/2011

* cited by examiner

*Primary Examiner* — Norman Yu
(74) *Attorney, Agent, or Firm* — Venable LLP

(57) ABSTRACT

The present invention makes it possible to reduce noise from a driving unit with a two-channel microphone configuration. An audio processing apparatus has a first microphone whose main acquisition target is sound from outside of the apparatus, a second microphone whose main acquisition target is driving noise from the driving unit, and a noise removing unit that generates two-channel audio data in which driving noise made by the driving unit of the apparatus has been reduced based on the difference between time-series audio data acquired by the first microphone and time-series audio data acquired by the second microphone. This noise removing unit has two adaptive filter units that respectively perform filter processing on time-series audio data from the first microphone and time-series audio data from the second microphone, and generates stereo two-channel audio data.

7 Claims, 9 Drawing Sheets

| DRIVING SPEED [pps] \ CENTER FREQUENCY [Hz] | f1 | f2 | f3 |
|---|---|---|---|
| 100 | 1000 | 1500 | 100 |
| 300 | 1000 | 1500 | 300 |
| ---- | ---- | ---- | ---- |
| 1000 | 1150 | 2000 | 1000 |
| ---- | ---- | ---- | ---- |

AUDIO PROCESSING APPARATUS AND CONTROL METHOD THEREOF

BACKGROUND OF THE INVENTION

Field of the Invention

The present invention relates to an audio processing technique.

Description of the Related Art

In recent years, functions of image capturing apparatuses such as cameras have been more and more improved. A large number of cameras that can shoot both a moving image/still image as part of the highly improved functions are seen. In moving image shooting, these cameras acquire a moving image and also acquire sound at the same time, and records the moving image and sound in synchronization. There is a problem with not a few cameras in that driving sound (driving sound of a focusing lens or a zoom lens) made by a driving unit of an optical system is recorded as noise.

Japanese Patent Laid-Open No. 2011-114465 is a document that discloses a denoising technique for eliminating or reducing such driving sound that is made at the time of driving for focusing and zooming.

In this document, a noise recording microphone for detecting noise of a driving unit is provided, and by subtracting an audio signal acquired by the noise recording microphone from an audio signal acquired by a normal sound recording microphone, driving noise is reduced.

However, image capturing apparatuses such as digital cameras have been more and more reduced in size and integrated. As a matter of course, a sound collection unit such as a microphone, a display unit for checking an image, an operation member, and the like are arranged at positions close to each other. Therefore, newly adding a noise recording microphone causes increase in cost and area.

In addition, in an interchangeable-lens shooting apparatus, the position of a driving unit differs according to a lens. Therefore, it is very difficult to arrange a noise recording microphone at a uniquely effective position.

In addition, commonly, a configuration for removal of noise of a driving unit is adopted in which time-series audio signals are converted into signals in a frequency domain through FFT or the like once, determination is made regarding noise of the driving unit and the noise is removed, and the signals are converted back into signals in a time domain (inverse FFT). Conversion into signals in a frequency domain is performed on collective time-series data, and thus there is a problem in that recording sound delays when executing noise removal processing.

SUMMARY OF THE INVENTION

The present invention provides a technique for removing or reducing noise made by a driving unit with a two-channel microphone configuration without newly adding a microphone dedicated to noise detection and without incurring the cost of audio processing.

According to an aspect of the invention, there is provided an audio processing apparatus, comprising: a driving unit; a first microphone whose main acquisition target is sound from outside of the apparatus; a second microphone whose main acquisition target is driving noise from the driving unit, compared with the first microphone; and a noise removing unit configured to generate two-channel audio data in which driving noise made by the driving unit has been reduced, based on a difference between time-series audio data acquired by the first microphone and time-series audio data acquired by the second microphone, wherein the noise removing unit includes: a determination unit configured to determine whether or not the driving noise occurred based on the difference between time-series audio data acquired by the first microphone and time-series audio data acquired by the second microphone, a correlation processing unit configured to obtain a correlation value between phases of time-series audio data acquired by the first microphone and time-series audio data acquired by the second microphone in a case where the determination unit determines that the driving noise occurred, a generation unit configured to generate time-series audio data for which an error of an incident angle of sound from the outside to the first microphone and the second microphone was determined to exceed a preset threshold, out of time-series audio data acquired by the first microphone and time-series audio data acquired by the second microphone, based on the correlation value, a first adaptive filter configured to receive inputs of time-series audio data acquired by the first microphone and time-series audio data corresponding to the first microphone and generated by the generation unit, perform adaptive filter processing, and generate audio data of one channel of stereo, and a second adaptive filter configured to receive inputs of time-series audio data acquired by the second microphone and time-series audio data corresponding to the second microphone and generated by the generation unit, perform adaptive filter processing, and generate audio data of the other channel of stereo.

According to the present invention, noise can be removed or reduced made by a driving unit with a two-channel microphone configuration, without newly adding a microphone dedicated to noise detection, without incurring the cost of processing for audio processing.

Further features of the present invention will become apparent from the following description of exemplary embodiments (with reference to the attached drawings).

DESCRIPTION OF THE EMBODIMENTS

An audio processing apparatus in embodiments according to the present invention will be described in detail below with reference to the attached drawings. Note that an example of an image capturing apparatus represented by a digital camera will be described below as an apparatus in which the audio processing apparatus is mounted, but the present invention is not limited thereto since the present invention can be applied to any apparatus having a driving unit that makes driving noise. It should be recognized that specific examples are shown for ease of understanding.

First Embodiment

Figure 2:
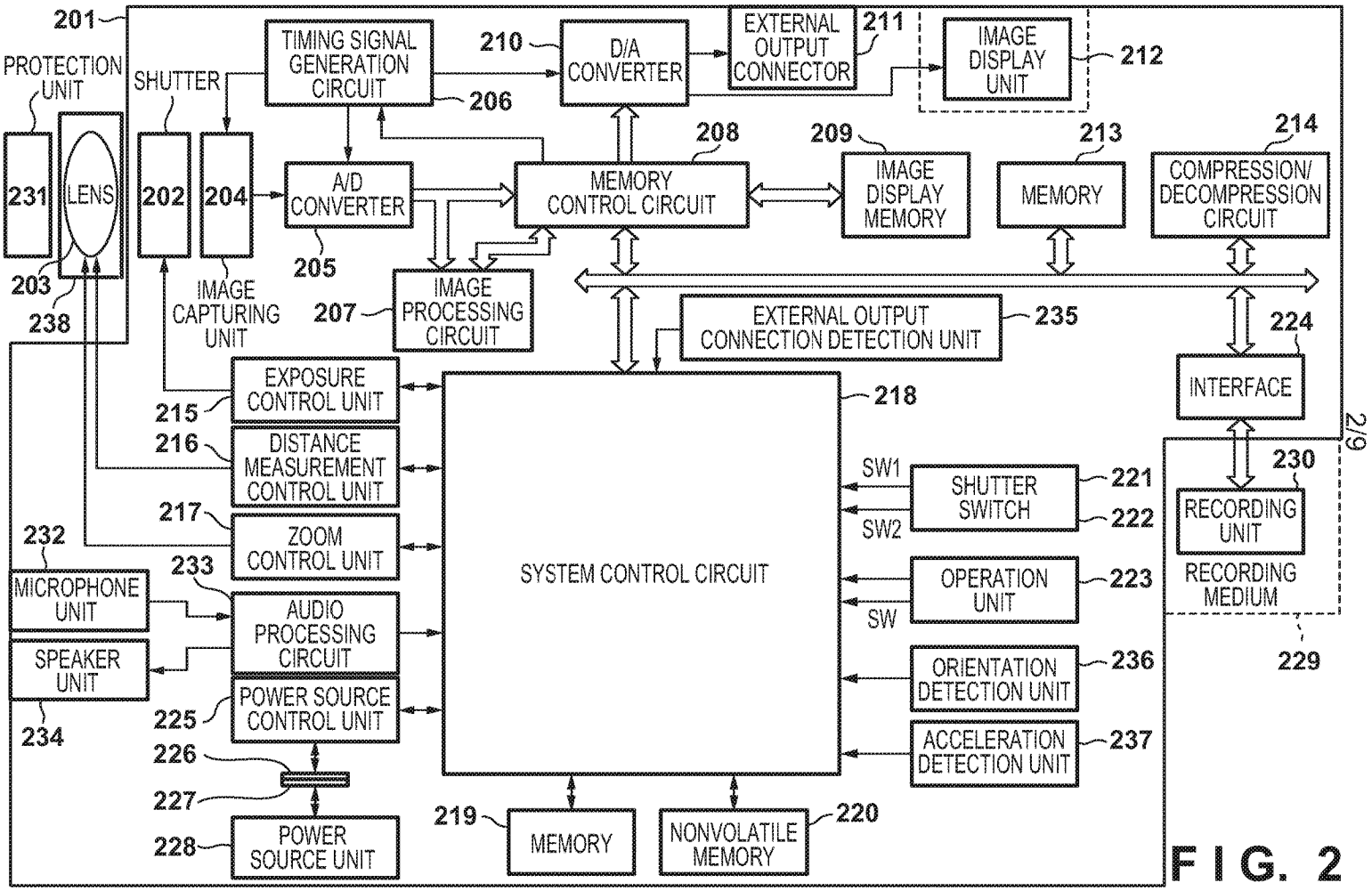
FIG. 2 is a block diagram showing the system configuration of a digital camera in an embodiment.

FIG. 2 is a block configuration diagram of an image capturing apparatus 201 that is adopted in the first embodiment. A shutter 202 has a diaphragm function. An image capturing unit 204 converts an optical image into electrical signals, and outputs analog signals indicating the intensity of light. An A/D converter 205 converts analog signals output from the image capturing unit 204 into digital signals. A timing signal generation circuit 206 is controlled by a memory control circuit 208 and a system control circuit 218, and supplies a clock signal and a control signal to the image capturing unit 204, the A/D converter 205, and a D/A converter 210. An image processing circuit 207 performs predetermined pixel interpolation processing and color conversion processing on data from the A/D converter 205 or data from the memory control circuit 208.

In addition, the image processing circuit 207 performs predetermined calculation processing using a captured image data. The system control circuit 218 then performs AF (autofocus) processing, AE (automatic exposure) processing, and light emission processing of an EF (flash) (not illustrated) based on the calculation result acquired from the image processing circuit 207. Furthermore, the image processing circuit 207 performs predetermined calculation processing using captured image data, and also performs AWB (automatic white balancing) processing of a TTL system based on the acquired calculation result.

The memory control circuit 208 controls the A/D converter 205, the timing signal generation circuit 206, the image processing circuit 207, an image display memory 209, the D/A converter 210, a memory 213, and a compression/decompression circuit 214. Data in the A/D converter 205 is written to the image display memory 209 or the memory 213 via the image processing circuit 207 and the memory control circuit 208, or is written to the image display memory 209 or the memory 213 directly via the memory control circuit 208.

An external output connector 211 outputs an output of the D/A converter 210 to an external monitor. The system control circuit 218 can detect whether or not a connector is inserted into the external output connector 211, based on a signal from an external output connection detection unit 235. Note that the external output connector 211 is a composite interface, for example. However, the external output connector 211 may be an HDMI (registered trademark) connector.

An image display unit 212 is constituted by a TFT LCD or the like, receives, via the D/A converter 210, image data that is to be displayed and is written in the image display memory 209, and displays the image data. If captured image data is sequentially displayed on the image display unit 212, a live view function can be realized. Also, the image display unit 212 can turn on/off display as appropriate according to an instruction of the system control circuit 218, and in the case where display is turned off, power consumption of the image capturing apparatus 201 can be reduced largely.

The memory 213 is a memory for temporarily storing still images and moving images that have been shot, and has a storage capacity sufficient for storing a predetermined number of still images and a moving image of a predetermined time. Accordingly, also in the case of continuous shooting in which a plurality of still images are continuously shot, and of panoramic shooting, a large amount of image data can be written to the memory 213 at a high speed. In addition, the memory 213 can also be used as a work area of the system control circuit 218. Furthermore, the memory 213 is also used as a writing buffer of a recording medium 229.

The compression/decompression circuit 214 is a circuit that compresses/decompresses image data through Adaptive Discrete Cosine Transform or the like, reads out image stored in the memory 213, performs compression processing or decompression processing, and writes the processed data to the memory 213.

The shutter 202 having a diaphragm function has a driving unit such as a motor that drives the diaphragm and shutter. An exposure control unit 215 controls the shutter 202 that has a diaphragm function by controlling an operation of the driving unit. A lens unit 238 has a taking lens 203 and a driving unit such as a motor that drives the taking lens 203. A distance measurement control unit 216 controls the driving unit within the lens unit 238 so as to control focusing. In addition, a zoom control unit 217 controls the driving unit of the lens unit 238 so as to control zooming. Note that, in embodiments of the present invention, the lens unit 238 is interchangeable.

The exposure control unit 215 and the distance measurement control unit 216 perform control using a TTL system. The exposure control unit 215 and the distance measurement control unit 216 are controlled by the system control circuit 218. Specifically, the system control unit 218 controls the exposure control unit 215 and the distance measurement control unit 216 based on a result of calculation performed by the image processing circuit 207 on captured and acquired image data.

The system control circuit 218 is a circuit that performs overall control of the image capturing apparatus 201, and includes a CPU. The system control circuit 218 realizes processing in the embodiments to be described later, by executing a program recorded in a nonvolatile memory 220.

A memory 219 is a memory in which constants and variables for operating the system control circuit 218, programs read out from the nonvolatile memory 220, and the like are deployed, and that allows a faster access speed than the memory 213 does. Typically, the memory 213 is a DRAM, and the memory 219 is an SRAM. The nonvolatile memory 220 is an electrically erasable and recordable memory. Constants for operating the system control circuit 218, programs, and the like are stored in the nonvolatile memory 220. The "program" mentioned here refers to a program for executing various flowcharts in the embodiments to be described later.

Shutter switches SW221 and SW222 and an operation unit 223 are operation units for inputting various operation instructions of the system control circuit 218, the operation units including one or more combinations of switches, a dial, a touch panel, an audio recognition apparatus, and the like. Here, these operation units will be described specifically. The shutter switch SW221 is turned on when a shutter button is operated halfway so as to instruct start of an operation of AF(autofocus) processing, AE (automatic exposure) processing, AWB (automatic white balancing) processing, or the like. The shutter switch SW222 is turned on when an operation on the shutter button is complete. When this shutter switch SW222 is turned on, the system control unit 218 performs exposure processing in which video signals from the image capturing unit 204 are converted into digital image data by the A/D converter 205, and the image data is written to the memory 213 via the memory control circuit 208. At the same time, the system control unit 218 instructs start of EF (flash lighting) processing (not illustrated) as necessary. In addition, the system control unit 218 causes developing processing to be performed using calculation of the image processing circuit 207 and the memory control circuit 208. In addition, the system control unit 218 performs a series of processing called recording processing in which image data is read out from the memory 213, is compressed by the compression/decompression circuit 214, and is written to the recording medium 229. In addition, in the case of moving image shooting, the system control unit 218 instructs various circuits to start/stop moving image shooting.

The operation unit 223 is constituted by various buttons, a touch panel, and the like. Types of button include a menu button, a setting button, a macro button, a multiscreen replay change page button, a flash setting button, single shooting/continuous shooting/self-timer switching button, a menu move +(plus) button, and a menu move -(minus) button. Also, a reproduced image move +(plus) button, a reproduced image -(minus) button, a shooting image quality selection button, an exposure correction button, a data/time setting button, a select/switch button for setting selection and switching of various functions, and a determination button for setting determination and execution of various functions are included. In addition, a display button for setting ON/OFF of the image display unit 212 is also included. A quick review ON/OFF switch for setting a quick review function for automatically reproducing data of shot image immediately after shooting is also included. Furthermore, a zoom operation unit for adjusting zoom and a wide angle during shooting, adjusting enlargement/reduction of an image during reproduction, and switching single-screen display/multiscreen display is also included in the operation unit 223. Furthermore, a compression mode switch for selecting a compression rate of JPEG compression, or for selecting a CCDRAW mode in which signals of the image capturing unit are digitized without compression and recorded to a recording medium is also included.

A power source control unit 225 detects whether or not a battery is mounted, a type of battery, and the battery remaining capacity, and supplies a necessary voltage to constituent elements including a recording medium for a necessary period of time, based on the detection result and an instruction of the system control circuit 218.

A power source unit 228 is constituted by a primary battery such as an alkaline battery or a lithium battery, a secondary battery such as NiCd battery, a NiMH battery, or a Li battery, an AC adapter, and the like. The power source control unit 225 and the power source unit 228 are connected to each other via respective electrodes 226 and 227 of the power source control unit 225 and the power source unit 228.

An interface 224 is an interface to a recording medium such as a memory card or a hard disk. The interface 224 may be configured by using an element conforming to a standard of an SD card, a CompactFlash (registered trademark) card, or the like. Furthermore, it is possible to mutually transfer image data and management information attached to image data with another device by connecting various communication cards to the interface 224.

A protection unit 231 is linked, in terms of operation, to the power source of the apparatus, and functions as a barrier that prevents the image capturing unit from being soiled and damaged by covering the image capturing unit that includes the taking lens 203 of the image capturing apparatus 201 when the power source is off.

A microphone unit 232 is an audio data acquisition unit that acquires audio data from a microphone. An audio processing circuit 233 performs A/D conversion such that the system control circuit 218 acquires audio data acquired by the microphone unit 232. In addition, the stereo microphone unit 232 is a microphone unit having two or more channels, but, in the embodiments, will be described as being a two-channel (stereo) microphone for ease of description.

A speaker unit 234 is an audio data output unit that outputs audio data from a speaker. The system control circuit 218 causes the audio processing circuit 233 to perform D/A conversion on processed audio data, and causes the speaker unit 234 to output the audio data, so as to reproduce sound.

The recording medium 229 is a recording medium such as a memory card or a hard disk. In addition, in the case where this recording medium 229 is a PCMCIA card or a CompactFlash (registered trademark) card, an information storage circuit in which its performance is written may be incorporated.

An orientation detection unit 236 detects inclination and rotation of the image capturing apparatus 201, and outputs orientation information indicating the orientation of the apparatus. An acceleration detection unit 237 obtains an acceleration for a movement amount of the apparatus in three axial directions, and outputs information regarding the acceleration.

The structure and processing/functions of the image capturing apparatus 201 in the embodiments have been described above.

Next, processing for removing driving sound in the embodiments will be described in detail with reference to FIGS. 1, 3, 4A, 4B, 5, and 6. "Driving sound" mentioned here refers to noise that is made by the driving unit in the lens unit 238 when the zoom control unit 217 performs zooming control of the taking lens 203 of the lens unit 238.

Figure 1:
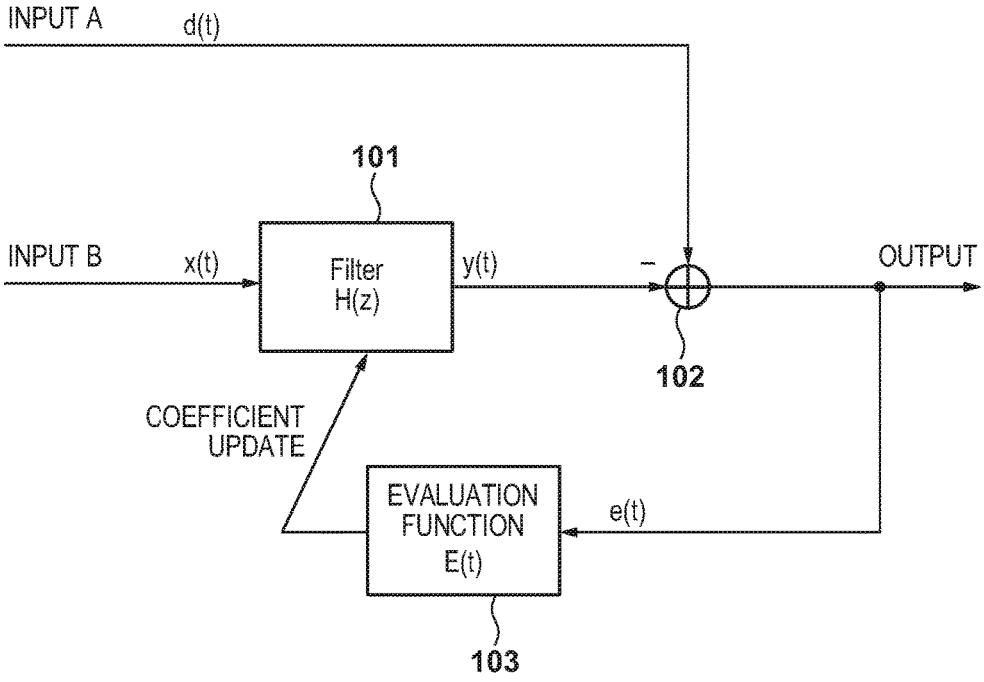
FIG. 1 is a block diagram showing an adaptive filter in an embodiment of the present invention.

First, the configuration of an adaptive filter will be described with reference to FIG. 1. FIG. 1 is a block diagram showing the configuration of the adaptive Filter. This adaptive filter also refers to a series of calculation processing that is performed by a program (not illustrated) recorded in advance in the memory 219 in FIG. 2. The system control circuit 218 reads out the program (not illustrated) from the memory 219, and sequentially executes this program on audio data that has been input via the audio processing circuit 233. The configuration and calculation processing of this adaptive filter will be described below in detail.

The adaptive filter has two inputs A and B, and includes a transversal filter circuit 101 that performs a product-sum operation on data from the input B, an evaluation unit 103 that updates a coefficient to be used by the transversal filter circuit 101, based on an evaluation function of an adaptive algorithm, and an adder 102 that adds output of the transversal filter circuit 101 and the input A.

In general, the input A is referred to as a desired signal, the input B is referred to as a reference signal, and an output is referred to as an output signal. In the case of using the adaptive filter as a noise removing unit, an audio signal that is generated from the source of noise to be removed is applied to the desired signal, an audio signal that includes an audio signal desired to be observed and to which the noise is added is applied to the reference signal, and an audio signal in which noise has been removed is acquired as an output signal.

The transversal filter circuit 101 includes a plurality of delay elements (not illustrated) that delay a reference signal x(t) acquired from the input B, a plurality of multipliers that multiply x(t) and delayed signals x(t-1) and x(t-2) by coefficients h0(t), h1(t), and h2(t) that have been set by the evaluation unit 103 in accordance with an evaluation function, and a plurality of adders that add outputs of the multipliers, and output an estimation signal y(t). At this time, t is a unit of time, and x(t) indicates a t-th sample in time-series audio digital data x.

The estimation signal y(t) is obtained from the following expression. m indicates the number of coefficients, and N indicates a natural number, and in the case where the adaptive filter has h0(t), h1(t), and h2(t) as coefficients, m=2 and N=3 hold.

$$y(t) = \sum_{m=0}^{N-1} h_m(t) \cdot x(t-m) \quad (m = 0, 1, \ldots, N-1) \tag{1}$$

In addition, the adder 102 that subtracts the estimation signal y(t) from a desired signal d(t) is provided, and coefficients of the transversal filter circuit 101 are updated by the evaluation unit 103 such that an error signal e(t), which is the output of the adder, and is a difference between the estimation signal y(t) and the desired signal d(t) approaches 0.

As a coefficient update algorithm, a Least Mean Square (LMS) algorithm has been conventionally in wide use. In this algorithm, coefficients are updated so as to minimize a mean square error E[e(t)2] of the error signal e(t). The preset coefficients h0(t), h1(t), and h2(t) are updated, and h0(t+1), h1(t+1), and h2(t+1) are derived.

The following expression indicates an LMS algorithm that is an example of coefficient update.

$$h_m(t+1) = h_m(t) + \mu \frac{x(t-m) \cdot e(t)}{\sum_{m=1}^{N-1} x^2(t-m)} \quad (m = 0, 1, \ldots, N-1) \tag{2}$$

μ in this expression is called a step size, and has a role of determining a size of coefficient update. Usually, a constant value is used, and a value of about 0.05 to 0.10 is used. It is desirable that the value of μ is determined in advance in accordance with the configuration of the image capturing apparatus 201, and when μ is small, accurate estimation is possible, but when μ is too large, filter output diverges.

Noise components desired to be removed are input to the reference signal x(t), and audio signals in which noise components are included are input to the desired signals d(t). By repeating the above series of processing, the error signal e(t) can be approached to 0, in other words, noise can be removed.

In addition, unlike FFT and the like, processing can be performed on each piece of audio data of one sample without using time-series collective audio data, and thus delay due to the processing doesn't occur.

Based on the above, a noise removal system in the embodiments will be described with reference to a block configuration diagram in FIG. 3.

This noise removal system is constituted by a MAIN microphone 301, a SUB microphone 302, an A/D conversion unit 303, and a noise removing unit 309. The MAIN microphone 301 and the SUB microphone 302 are microphones that constitute the two-channel microphone unit 232. Details will be apparent from the following description, but the MAIN microphone 301 is a microphone whose main acquisition target is sound from the outside of the apparatus. In addition, the SUB microphone 302 is a microphone whose main acquisition target is driving noise from the driving unit of the lens unit 238 as compared with the MAIN microphone 301. The A/D conversion unit 303 is a circuit included in the audio processing circuit 233. In addition, processing of the noise removing unit 309 is a series of calculation processing realized by the system control circuit 218 executing a program (not illustrated) recorded in advance in the memory 219 in FIG. 2. This program is stored in the nonvolatile memory 220, and is read out to the memory 219 and executed by the system control circuit 218. The system control circuit 218 sequentially executes this program, so as to perform processing on audio data that has been input by the audio processing circuit 233.

Here, the mechanical configuration of the two-channel microphone unit 232 of this embodiment will be described in detail with reference to FIGS. 4A and 4B.

Figure 4A:
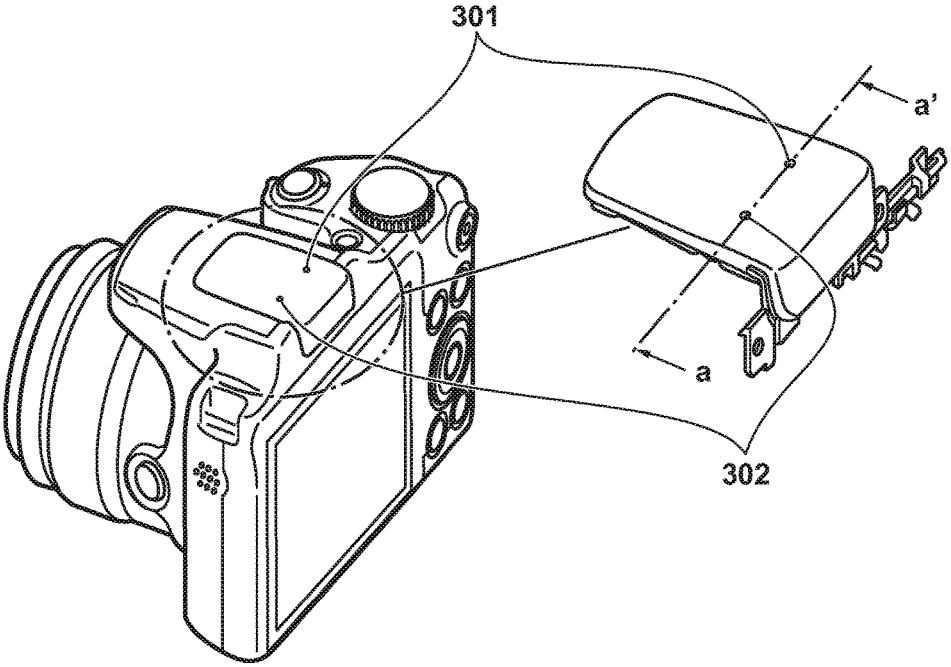
FIGS. 4A and 4B are mechanical configuration diagrams showing the configuration of a microphone unit in the first embodiment.

FIG. 4A is an external view of the image capturing apparatus 201 of this embodiment. When viewed from the photographer holding the image capturing apparatus 201 directed to the subject, the MAIN microphone 301 is on the right, and the SUB microphone 302 is on the left. The MAIN microphone 301 and the SUB microphone 302 are arranged symmetrically relative to the central position of a viewpoint of the image capturing unit in order to ultimately function as a stereo microphone.

Figure 4B:
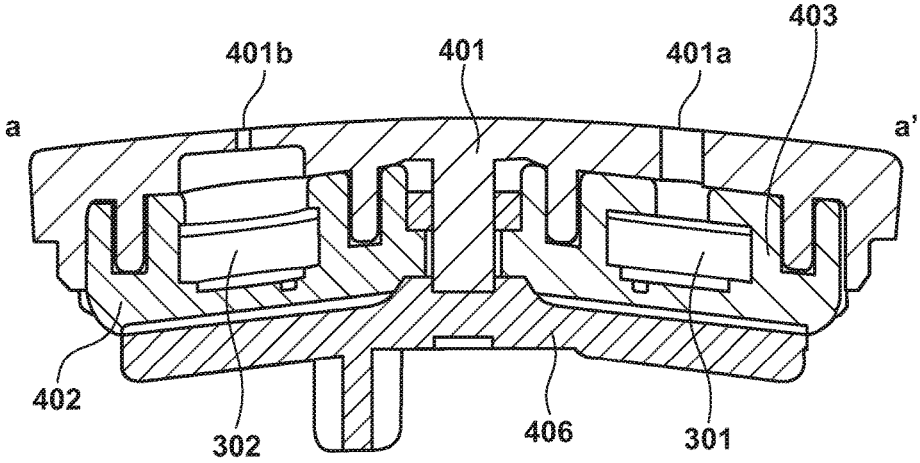

FIG. 4B is an enlarged view of a cross section taken along a broken line a-a' in FIG. 4A of the mechanical configuration of the MAIN microphone 301 and the SUB microphone 302 that constitute portions of the microphone unit 232.

The enlarged view in FIG. 4B includes an exterior unit 401 that configures opening portions (hereinafter, referred to as microphone holes) for allowing acoustic oscillation that is propagated by air to pass, a MAIN microphone bush 403 that holds the MAIN microphone 301, a SUB microphone bush 402 that holds the SUB microphone 302, and a pressing unit 406 that presses the microphone bushes toward the exterior unit 401 so as to hold the microphone bushes. The exterior unit 401 and the pressing unit 406 are each formed by a mold member such as a PC material, but there is no problem if the exterior unit 401 and the pressing unit 406 are metal members of aluminum, stainless, or the like. In addition, the MAIN microphone bush 403 and the SUB microphone bush 402 are made of a rubber material such as ethylene-propylene-diene rubber.

Here, the hole diameters (areas) of the microphone holes in the exterior unit 401 will be described. The diameter of a microphone hole 401*b* leading to the SUB microphone 302 is smaller than the diameter of a microphone hole 401*a* leading to the MAIN microphone 301, and the microphone hole 401*b* has a configuration acquired by reducing the microphone hole 401*a* at a predetermined magnification. The microphone hole shape is desirably circular or elliptic, but may be rectangular. In addition, the shapes of those holes may be the same or different. This configuration aims to make driving noise that is transmitted to the microphones by being propagated by air within the image capturing apparatus be unlikely to leak from the microphone hole side of the SUB microphone 302 to the outside.

Next, spaces in front of the microphones formed by the exterior unit 401 and the microphone bushes will be described. The space in front of the SUB microphone 302 formed by the exterior unit 401 and the SUB microphone bush 402 is configured to secure a larger space volume than the space in front of the MAIN microphone 301 formed by the exterior unit 401 and the MAIN microphone bush 403 at a predetermined magnification. With this configuration, in the space in front of the SUB microphone 302, a change in the air pressure in the space increases, and driving noise (in the embodiments, driving sound of a zoom lens) from the driving unit of the lens unit 238 is emphasized.

As described above, in a mechanical configuration of microphone input, amplitude of driving noise in an input to the SUB microphone 302 is emphasized more than that in an input to the MAIN microphone 301. Regarding the relationship of audio level of driving noise, the audio level at which driving noise is input to the SUB microphone 302 is higher than the audio level at which driving noise is input to the MAIN microphone 301. In addition, conversely, regarding the relationship of audio level of sound (sound in the surrounding environment that is essentially intended to be collected), the level of sound that is input from the front of the microphone hole to the MAIN microphone 301 through air propagation is higher than the level of sound that is input from the front of the microphone hole to the SUB microphone 302.

As described above, one microphone (the MAIN microphone 301) out of two channel microphones constituting the microphone unit 232 has a holding configuration for being likely to pick up external sound and being less likely to pick up internal sound due to its structure, and has a role of acquiring environmental sound. Also, the other microphone (the SUB microphone 302) has a holding configuration for being likely to pick up internal sound, and being less likely to pick up external sound, and has a role of acquiring information regarding driving sound. With such a configuration, driving sound is recorded by the SUB microphone so as to be louder than the MAIN microphone, but sound in the surroundings of the subject comes from a position sufficiently farther from both the microphones, and is thus output at substantially the same magnitude by both the microphones.

Next, processing related to the MAIN microphone 301 and SUB microphone 302 will be described in detail with reference to FIGS. 3 and 5. Driving noise in the embodiments is a sound that is made at the time of zoom driving, and the source of the noise is the image capturing apparatus itself. Therefore, the distance between the source of the driving noise and each microphone is much shorter than the distance between the subject and the image capturing apparatus at the time of image capturing. Therefore, it can be said that the phase difference of driving noise that is detected by the MAIN microphone 301 and the SUB microphone 302 is negligibly small. On the other hand, it should be noted that sound that is propagated from the outside of the apparatus, and is detected by the MAIN microphone 301 and the SUB microphone 302 has a phase difference as a matter of course.

Figure 3:
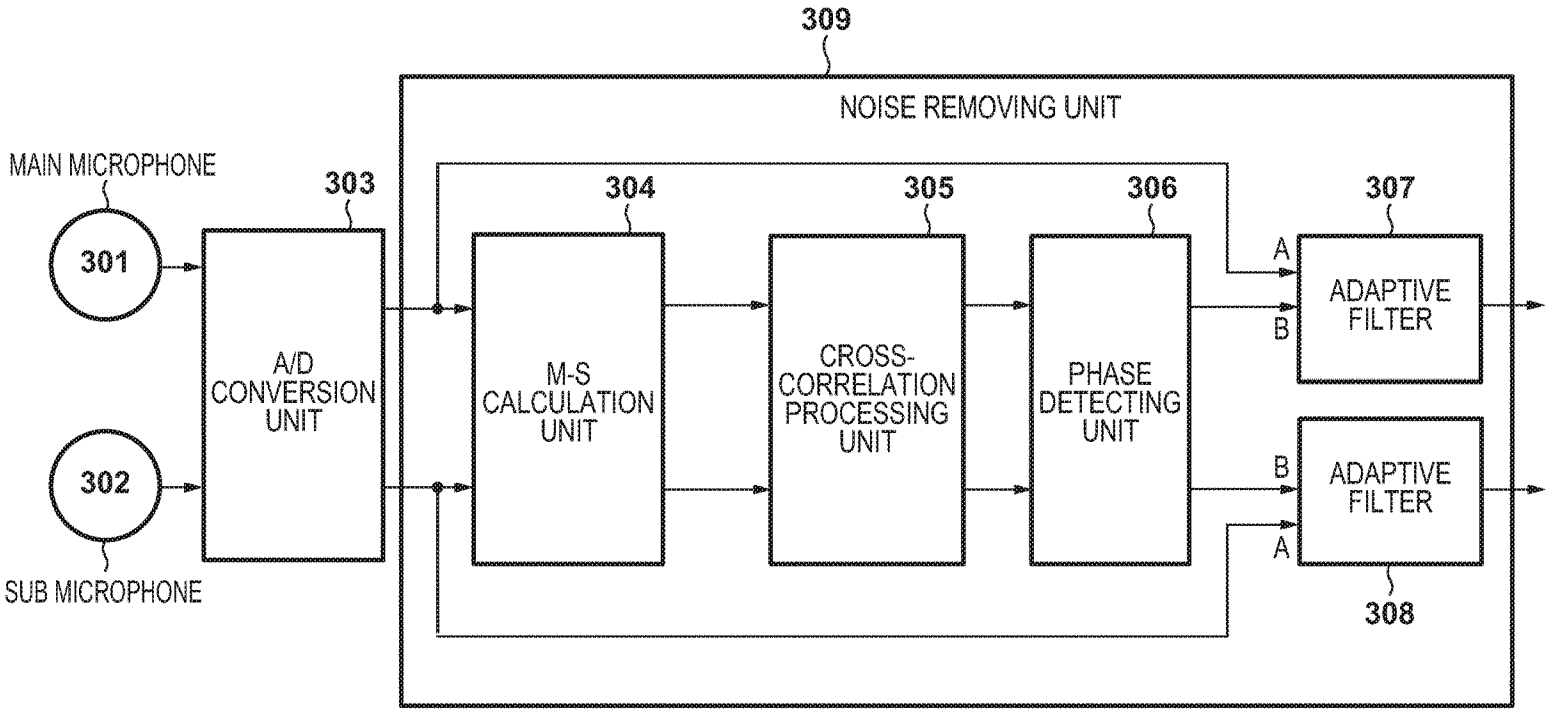
FIG. 3 is a block diagram showing a noise removal system in a first embodiment.

In FIG. 3, the A/D conversion unit 303 converts audio signals of the MAIN microphone 301 and the SUB microphone 302 into digital signals in a preset sampling cycle (e.g., 44.1 KHz). An M-S calculation unit 304 functions as a determination unit that determines whether or not there is driving noise from the audio signals acquired from the MAIN microphone 301 and the SUB microphone 302.

Figure 5:
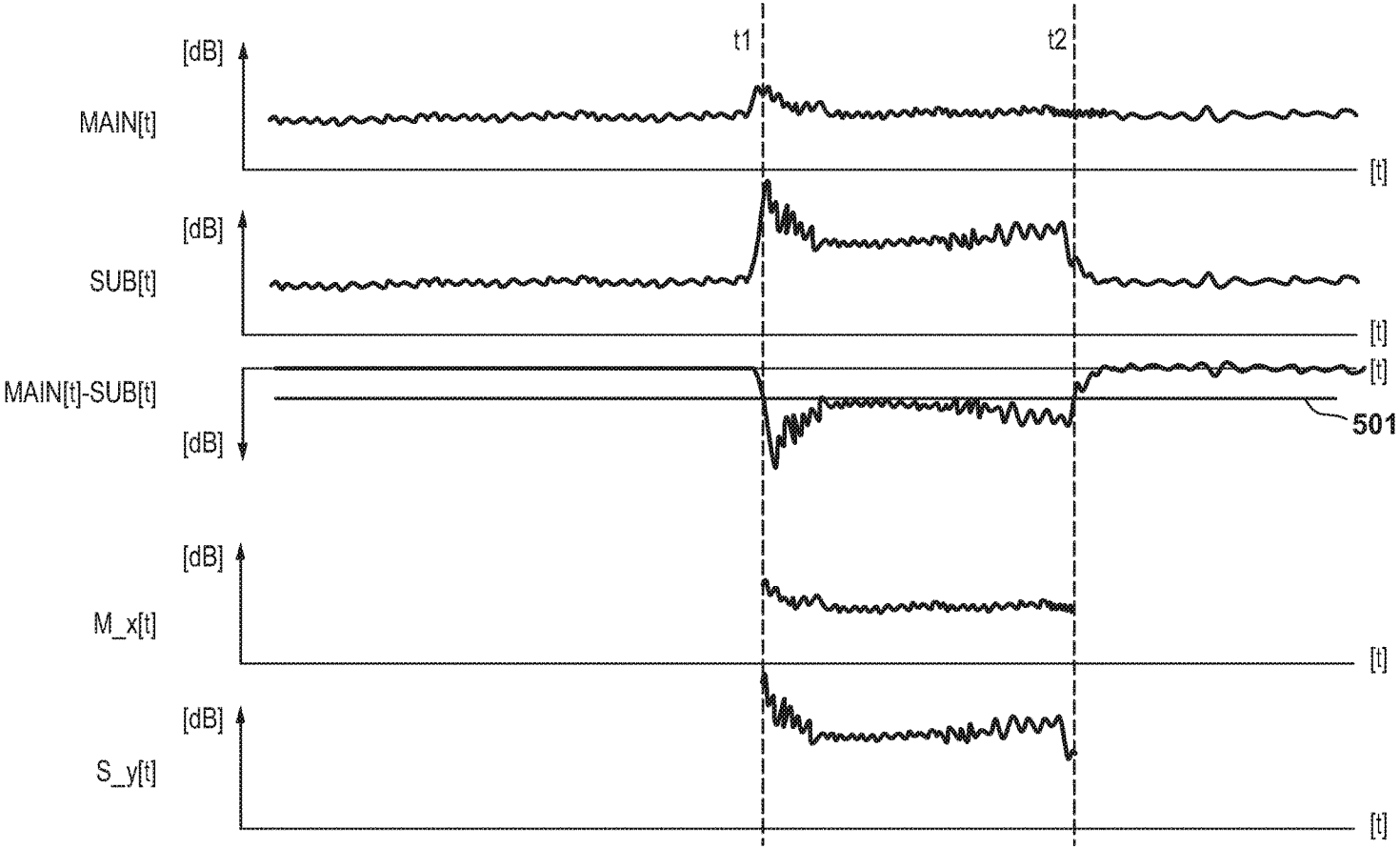
FIG. 5 is an operation timing chart of an M-S calculation unit in the first embodiment.

An operation timing chart in FIG. 5 shows an operation of the M-S calculation unit 304.

In FIG. 5, MAIN[t] and SUB[t] indicate audio signals of t-th samples of the MAIN microphone 301 and the SUB microphone 302. In addition, MAIN[t]-SUB[t] indicates a subtraction amount acquired by subtracting the signal of the SUB microphone 302 from the audio signal of the MAIN microphone 301. In addition, a period of a timing t1 to a timing t2 indicates a driving period of a zoom lens.

As described above, in the MAIN microphone 301 and the SUB microphone 302, driving noise from the driving source within the apparatus that is superimposed on sound from the outside of the apparatus is detected. Note that a main target of the MAIN microphone 301 is sound from the outside of the apparatus, compared with the SUB microphone 302. Conversely, a main target of the SUB microphone 302 is driving noise, compared with the MAIN microphone 301. Therefore, during a period during which the zoom lens is in a non-driving state before the timing t1, driving noise does not occur, and thus MAIN[t]-SUB[t] mostly takes a positive value as illustrated.

Subsequently, it is found that, during a period from the timing t1 to the timing t2 that is a driving period of the zoom lens, SUB[t] increased largely relative to MAIN[t], and the subtraction amount MAIN[t]-SUB[t] takes a negative value to fall below a zoom detection threshold 501 (a threshold having a negative value). Accordingly, it can be said that the period from the timing t1 to the timing t2 is a period during which a noise occurrence state is exhibited.

The M-S calculation unit 304 obtains the subtraction amount MAIN[t]-SUB[t] from the signals of MAIN[t] and SUB[t]that have been input, and outputs, as M_x[t] and S_x[t], signals of MAIN[t] and SUB[t] during a period during which this subtraction amount is smaller than the zoom detection threshold. Here, M_x[t] corresponds to MAIN[t], and S_x[t] corresponds to SUB[t].

As illustrated in the timing chart in FIG. 5, the output of MAIN[t] during the period t1 to t2 is M_x[t], and the output of SUB[t] during the period t1 to t2 is S_x[t]. Note that, during a period during which the subtraction amount MAIN [t]-SUB[t] takes 0 or a positive value, M_x[t] and S_x[t] take a value of zero.

At this time, t is a unit of time, and x[t] indicates a t-th sample in the time-series audio digital data x.

Note that, in the embodiments, letting that a threshold having a negative value be Th, in the state where MAIN[t]-SUB[t]<Th is satisfied, the M-S calculation unit 304 determines that there is driving noise, and the values of MAIN[t] and SUB[t] at this time are output as M_x[t] and S_x[t]. In the state where MAIN[t]-SUB[t]>Th is satisfied, the M-S calculation unit 304 outputs the values of MAIN[t] and SUB[t] as M_x[t]=S_x[t]=0.

However, a determination method based on a threshold is not limited to the above. For example, a configuration may be adopted in which the threshold Th that is appropriate and positive is defined, and if SUB[t]-MAIN[t]>Th, it is determined that there is driving noise. In short, it is sufficient that it can be determined that there is driving noise on the condition that the value of audio data acquired by the SUB microphone 302 is sufficiently larger than the value of audio data acquired by the MAIN microphone 301.

Next, the M-S calculation unit 304 sequentially supplies the output data M_x[t] and S_x[t] to a cross-correlation processing unit 305 and a phase detecting unit 306. The cross-correlation processing unit 305 and the phase detecting unit 306 perform processing aimed for accurate determination/extraction of driving sound. The cross-correlation processing unit 305 and the phase detecting unit 306 perform processing for accurately extracting only driving sound caused by zooming control, from the digital data M_x[t] and S_x[t] that has been output form the M-S calculation unit 304.

First, the cross-correlation processing unit 305 examines the cross-correlation between M_x[t] that is an output signal of the MAIN microphone from the M-S calculation unit 304 and S_x[t] that is an output signal of the SUB microphone.

The output of the M-S calculation unit 304 is signals of MAIN[t] and SUB[t] during a period during which the difference between outputs of the microphones is large and the subtraction amount exceeds the zoom detection threshold 501 (the subtraction amount is smaller than the zoom detection threshold 501). Therefore, there are cases where these pieces of data includes environmental sound that occurred during a zoom period, and the like.

The cross-correlation processing unit 305 selects and outputs mutually highly correlated signals in order to extract only driving sound from these pieces of data. There is a level difference between these pieces of data, namely two inputs M_x[t] and S_x[t], but their rise times and fall times are substantially matched, wave forms are likely to overlap, and the cross-correlation value tends to be high. The content of this processing is indicated in the Expression 3 below.

$$\varphi_{ms} = \frac{\sum_{j=1}^{M} \mathrm{M_x}[t] \cdot \mathrm{S_x}[t+j]}{M} \quad (j = 0, 1, 2, \ldots, M) \tag{3}$$

These two inputs are shifted by M samples, and are summed. M is a preset value, and is stored in a recording unit 230 in FIG. 2. M is affected by the configuration of a product body and the like, but it is desirable that M is as small a value (about 1 to 5) as possible.

In the case where φms takes a positive value in Expression 3, it can be determined that the cross-correlation is high. Therefore, the cross-correlation processing unit 305 obtains M at which φms is positive and maximum. The cross-correlation processing unit 305 then outputs the obtained M and a result of shifting the obtained M as M_x'[t] and S_x'[t].

In addition, a threshold for this sum is affected by the configuration of the product body and the microphone arrangement, and thus there may be a configuration in which adjustment is made for each product, and a correction term or the like is added. In this case, a correction term is held in a nonvolatile recording apparatus such as the nonvolatile memory 220.

The outputs M_x'[t] and S_x'[t] of the cross-correlation processing unit 305 are next input to the phase detecting unit 306. The phase detecting unit 306 then performs phase difference detection processing, and generates time-series audio data for MAIN and SUB. The content of the processing will be described with reference to FIG. 6.

Figure 6:
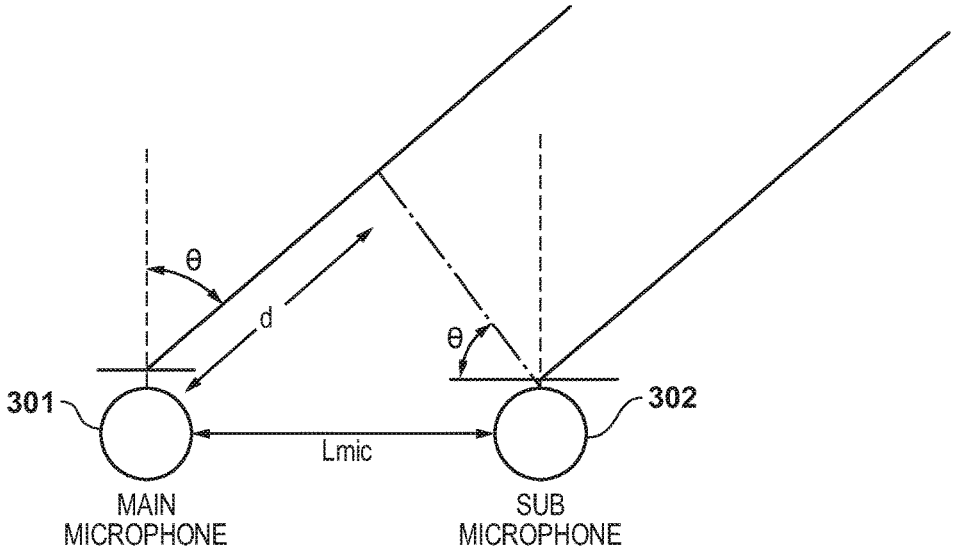
FIG. 6 is a conceptual diagram of phase difference detection in an embodiment.

In FIG. 6, letting that the distance between the MAIN microphone 301 and SUB microphone be Lmic, and an incident angle at which sound enters be θ, the phase difference is derived from the following expressions.

$$\theta = \sin^{-1}\left(\frac{d}{L_{mic}}\right) \tag{4}$$

$$d = Cj \tag{5}$$

$$\Delta\theta = G \tag{6}$$

C is a sound speed, and j is the number of samples that have been shifted in order to acquire correlation in Expression 3. G is a threshold for Δθ, and is a value that has been examined according to the configuration of the image capturing apparatus 201, and that is recorded in advance in the nonvolatile memory 220 in FIG. 2.

In the case where the phases of audio data are aligned when Expressions 4 and 5 are calculated, θ=0 holds.

Driving sound is propagated inside the image capturing apparatus 201, and is thus transmitted along various members that hold the microphone unit 232, and is recorded as audio data. There are various propagation paths, and thus, in the case where phase detection as shown in FIG. 6 is performed, the value of the incident angle θ at which sound enters is not constant, and temporal change becomes intense.

In this embodiment, using this property, the phase detecting unit 306 has a configuration in which audio data is allowed to pass in the case where the phase difference Δθ per unit time is larger than the threshold G, and zero is output in the case where Δθ is smaller than or equal to the threshold G, in order to select noise propagated inside the case. The phase detecting unit 306 can determine whether or not driving sound is transmitted internally along the case, and extract the driving sound, by outputting M_x'[t] and S_x'[t] corresponding to Expression 6 as M_x"[t] and S_x"[t] to later-stage processing.

A MAIN channel adaptive filter 307 receives inputs of the signal M_x"[t] that has passed through phase detection and the signal MAIN[t] that has passed through the A/D conversion unit 303, performs filter processing, and outputs an audio signal of one channel of stereo (according to FIGS. 4A and 4B, a stereo R-channel audio signal) in which driving noise has been removed or reduced.

On the other hand, a SUB channel adaptive filter 308 receives inputs of a signal S_x"[t] that has passed through phase detection and the signal SUB[t] that has passed through the A/D conversion unit 303, performs filter processing, and outputs an audio signal of the other channel of stereo (according to FIGS. 4A and 4B, a stereo L-channel audio signal) in which driving noise has been removed or reduced.

Subsequently, after the system control circuit 218 applies processing for adjusting gain of each channel and processing for emphasizing the stereo feeling, the sound is coupled to moving image data, and the moving image data is converted into a MOV or MPEG file, which is recorded in the recording unit 230 in FIG. 2 as a moving image file with sound.

As described above, driving sound can be removed by adopting a configuration in which an audio signal that doesn't have cross-correlation, and in which phase detection is not possible is separated as noise that is driving sound propagated inside the case, and this signal is used as a reference signal to perform noise removal through adaptive filter processing.

Note that, in the embodiments, description has been given in which the constituent elements of the noise removing unit 309 shown in FIG. 3 serve as function units that are caused to execute a program by the system control circuit 218. In this case, the constituent elements are implemented as arithmetic functions, and a sequence of processing among the constituent elements is as shown in FIG. 3. Therefore, FIG. 3 can be regarded as a flowchart that is executed by the system control circuit 218. Note that some or all of the constituent elements in FIG. 3 may be realized by hardware.

As described above, according to the embodiments, compared with conventional techniques in which FFT (Fast Fourier Transform) is used, there is no period during which a large amount of audio data for FFT is accumulated, and thus a delay amount of processing related to driving noise removal can be reduced by this period. As a result, for example, in the case where the noise removing unit 309 illustrated in the embodiment is mounted in an image capturing apparatus such as a digital video camera, an operation of recording a captured image can be performed while checking actual sound after denoising using a headphone or the like.

Second Embodiment

A second embodiment will be described below. An image capturing apparatus in this second embodiment is the same as the image capturing apparatus in FIG. 2 of the first embodiment, and thus description of processing units is omitted.

Figure 7:
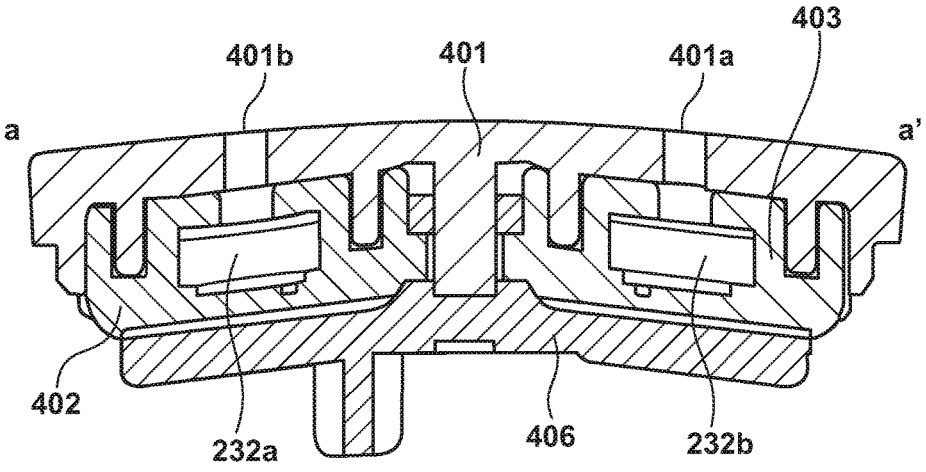
FIG. 7 is a mechanical configuration diagram of a microphone unit in a second embodiment.

In addition, a microphone unit 232 in this second embodiment includes two microphones similar to the first embodiment, but those two microphones detect sound in the surrounding environment of the same level. FIG. 7 shows a cross sectional structure taken along the broken line a-a' of the mechanical configuration in FIG. 4A. A microphone 232*a* is an L-channel microphone, a microphone 232*b* is an R-channel microphone, and those microphones constitute the microphone unit 232.

In the first embodiment described above, the diameter of the microphone hole 401*a* is larger than that of the microphone hole 401*b*, but those diameters are the same in this second embodiment. The sizes of the spaces in front of the microphones 232*a* and 232*b* are also the same. As a result, the two microphones 232*a* and 232*b* detect sound in the surrounding environment of the same level.

In addition, in this second embodiment, driving noise sound is noise sound that is made when focusing of a lens 203 within a lens unit 238 is performed. In addition, the lens unit 238 is interchangeable.

Figure 8:
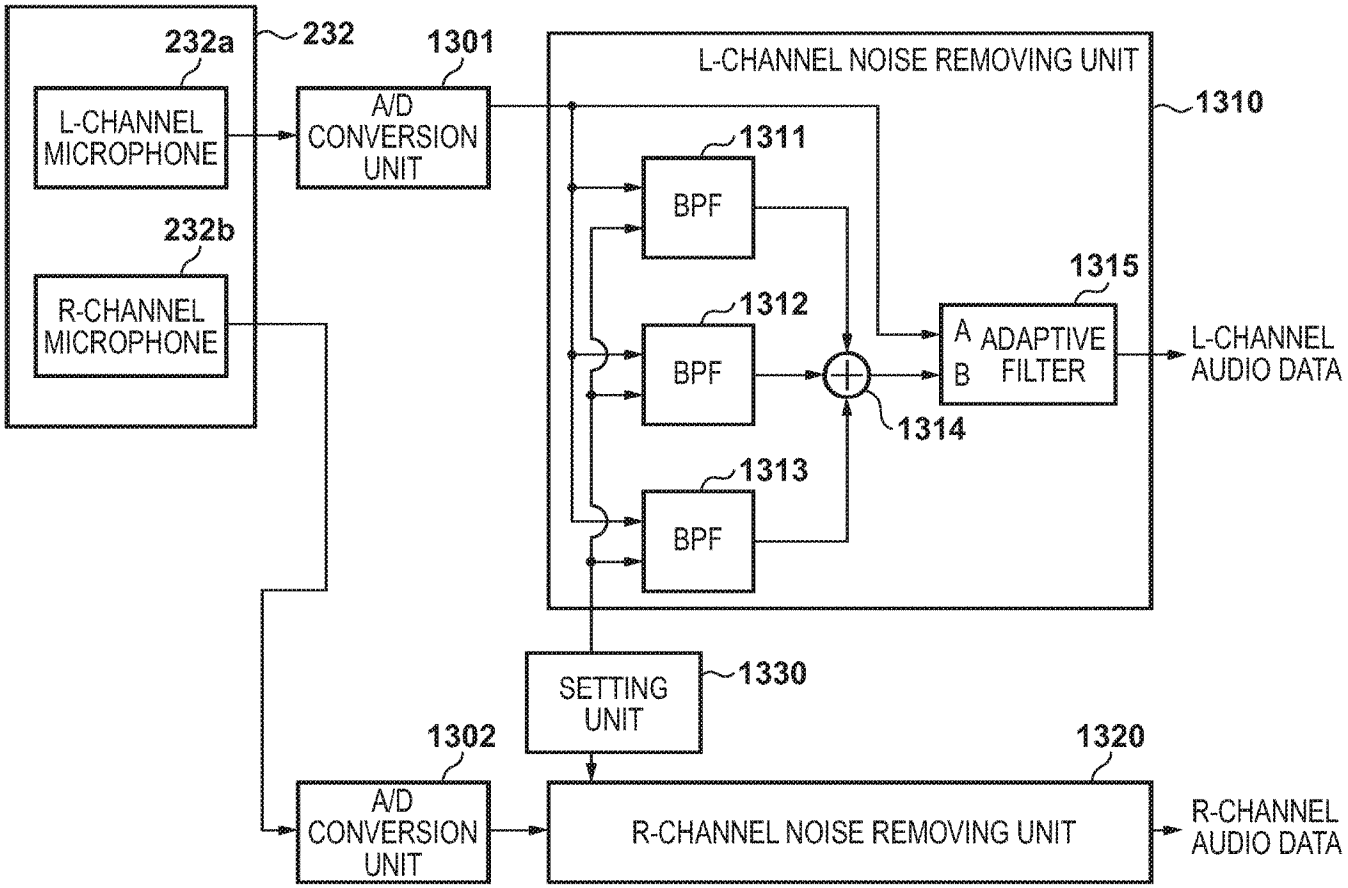
FIG. 8 is a block diagram showing a noise removal system in the second embodiment.

FIG. 8 is a block configuration diagram of main constituent elements of a noise removal system in the second embodiment.

The microphone unit 232 has the L-channel microphone 232*a* and the R-channel microphone 232*b* that constitute a stereo microphone. An A/D conversion unit 1301 converts analog audio signals acquired by the L-channel microphone 232*a* into digital data. An A/D conversion unit 1302 converts analog audio signals acquired by the R-channel microphone 232*b* into digital data. The A/D conversion unit 1301 and 1302 are both included in an audio processing circuit 233.

An L-channel noise removing unit 1310 and an R-channel noise removing unit 1320 are independent from each other. The L-channel noise removing unit 1310 and the R-channel noise removing unit 1320 perform processing for removing driving noise (to be described later in detail) that is based on a parameter that has been set from a setting unit 1330, and outputs L-channel audio data and R-channel audio data after noise removal. The L-channel noise removing unit 1310, the R-channel noise removing unit 1320, and the setting unit 1330 are realized by a system control circuit 218 executing a program stored in a memory 219. This program is initially stored in a nonvolatile memory 220, and is then executed after being read out to the memory 219. Note that any of the L-channel noise removing unit 1310, the R-channel noise removing unit 1320, and the setting unit 1330 may be realized as hardware.

The L-channel noise removing unit 1310 and the R-channel noise removing unit 1320 have the same configuration. Therefore, the L-channel noise removing unit 1310 and the setting unit 1330 will be described below.

Analog audio signals collected by the L-channel microphone 232a are converted into digital audio data by the A/D conversion unit 1302, and the digital audio data is supplied to the L-channel noise removing unit 1310.

BPFs (band pass filters) 1311, 1312, and 1313 in the L-channel noise removing unit 1310 restrict frequencies corresponding to parameters (center frequencies or peak frequencies) that have been set by a setting unit 330, so as to sort signals. The BPFs 1311, 1312, and 1313 then output band-filtered audio data to an adder 1314. The adder 1314 supplies audio data that is an addition result to an input terminal B of an adaptive filter 1315. In addition, digital data from the A/D conversion unit 1301 is supplied to an input terminal A of the adaptive filter 1315. The adaptive filter 1315 has the same configuration as the configuration shown in FIG. 1. The adaptive filter 1315 regards audio data that has been input to the input terminal B as noise component data, subtracts the noise component data from the input terminal B, from the audio data from the input terminal A, and outputs the result as L-channel audio data after noise removal.

As described above, the system control circuit 218 receives output of audio data acquired from the L-channel noise removing unit 1310 and audio data acquired from the R-channel noise removing unit 1320, performs encoding processing and the like, and performs processing for storing a file of moving image data with sound to a storage medium 229.

In a shooting apparatus in this second embodiment, due to focusing processing within the lens unit 238, noise is made centered on a specific frequency (that includes one or more frequency peaks) by a driving unit that drives the mounted lens 203. Thus, by performing a series of processing separately for each center frequency band, the convergence speed of adaptive filter processing can be improved. However, the frequency of driving noise differs according to the type of the lens 203. In addition, the frequency of driving noise differs also according to the driving speed of the lens 203.

In the embodiments, the BPFs 1311, 1312, and 1313 are provided as band pass filters. This is because the number of frequency peaks of driving noise is envisioned to be three at maximum. The number of BPFs may be further increased in order to improve the accuracy.

Letting the center frequency be $f_{cn}$, a transfer function of a band pass filter can be expressed as the following expression.

$$H(s) = \frac{1}{s^2 + \sqrt{2}\,s + 1} \tag{7}$$

$$s = \frac{s^2 + 4\pi^2 f_{c1} f_{c2}}{2\pi(f_{c2} - f_{c1})s} \tag{8}$$

Figures 9A, 9B:
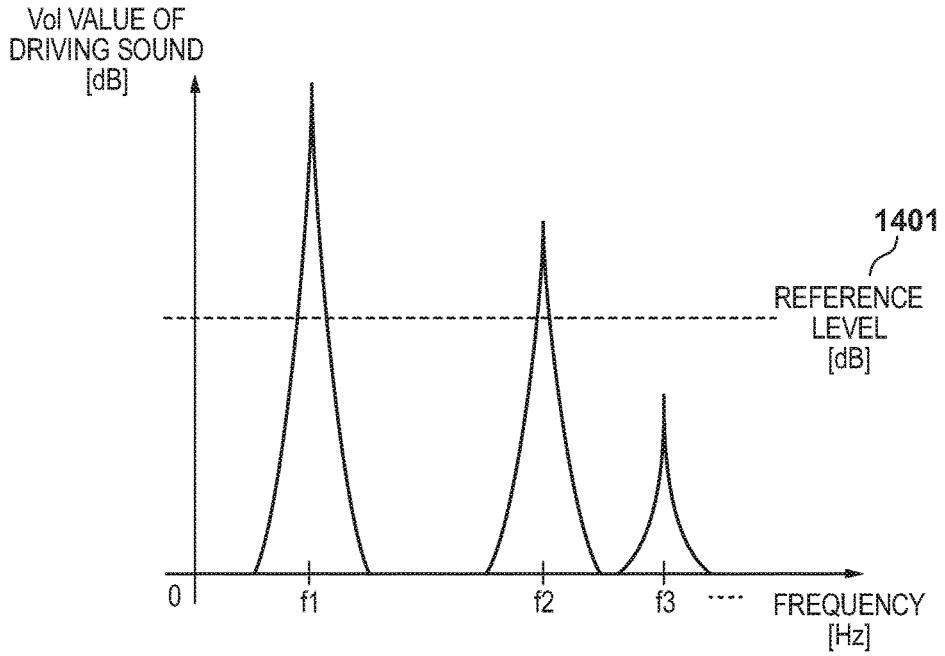
FIGS. 9A and 9B are diagrams showing an example of frequency distribution of driving noise of a lens and a table thereof in the second embodiment.

FIG. 9A shows an example of frequency distribution of driving noise made by driving the lens unit 238. In a certain lens, as illustrated, driving noise that is made due to a lens being driven has three peaks, namely center frequencies f1, f2, and f3. The peaks of the center frequencies f1 and f2 out of those three center frequencies exceed a reference level 1401. FIG. 9B shows a driving noise removal table group in this second embodiment. This table group is stored in the nonvolatile memory 220, and one table that constitutes the table group corresponds to one type of lens unit. When this apparatus is turned on, the setting unit 330 (the system control circuit 218) identifies the type of the lens unit 238, and selects one table from the driving noise removal table group according to the type.

Center frequencies (or information for identifying center frequencies) that are respectively set for the three BPFs are stored in one table for each driving speed (pps). The center frequencies for BPFs stored in one table correspond to center frequencies of peaks included in driving noise that occurs when the lens unit 238 corresponding to the table is driven at a corresponding driving speed. A method for identifying the type of the lens unit 238 is a known technique, and is not limited particularly. In the embodiments, type of the connected lens unit 238 (model name) is identified by communicating with a control unit within the lens through serial communication. The setting unit 330 references the selected table in accordance with the identified type of the lens unit 238, reads out, from the selected table, the center frequencies f1, f2, and f3 corresponding to the driving speed when driving the lens unit 238, and sets the center frequencies f1, f2, and f3 in BPFs 1311, 1312, and 1313 respectively. As a result, the BPFs 1311, 1312, and 1313 allow driving noise in preset ranges from the respective center frequencies to pass (filter), and attenuates signals in the other frequency bands. The adder 1314 combines audio data (driving noise) from the BPFs 1311, 1312, and 1313, generates composite driving noise data unique to the connected lens unit 238, and supplies the generated data to the adaptive filter 1315. Note that, in some cases, there are two peaks of noise during driving depending on a lens unit. In that case, center frequencies of peaks of two out of three frequencies are stored in the table, and, regarding the remaining frequency, zero is stored. In the case where the frequency is zero, the corresponding BPF functions such that audio data in the entire frequency band is not allowed to pass.

At the time of a preparation operation or the like until shooting becomes possible after a shooting apparatus 201 is turned on, the system control circuit 218 communicates with the connected lens unit 238, acquires the model type of the lens unit 238, and selects a corresponding setting value of the lens unit 238 from its setting value group from the nonvolatile memory 220. After that, the system control circuit 218 reads out center frequencies corresponding to the driving speed immediately before the lens unit 238 is driven, and sets BPFs 1304, 1306, and 1308. Accordingly, the BPFs 1304, 1306, and 1308 can be configured as band pass filters having a frequency property of allowing audio data in center frequencies of noise corresponding to the mounted lens unit 238 to pass.

Figure 10:
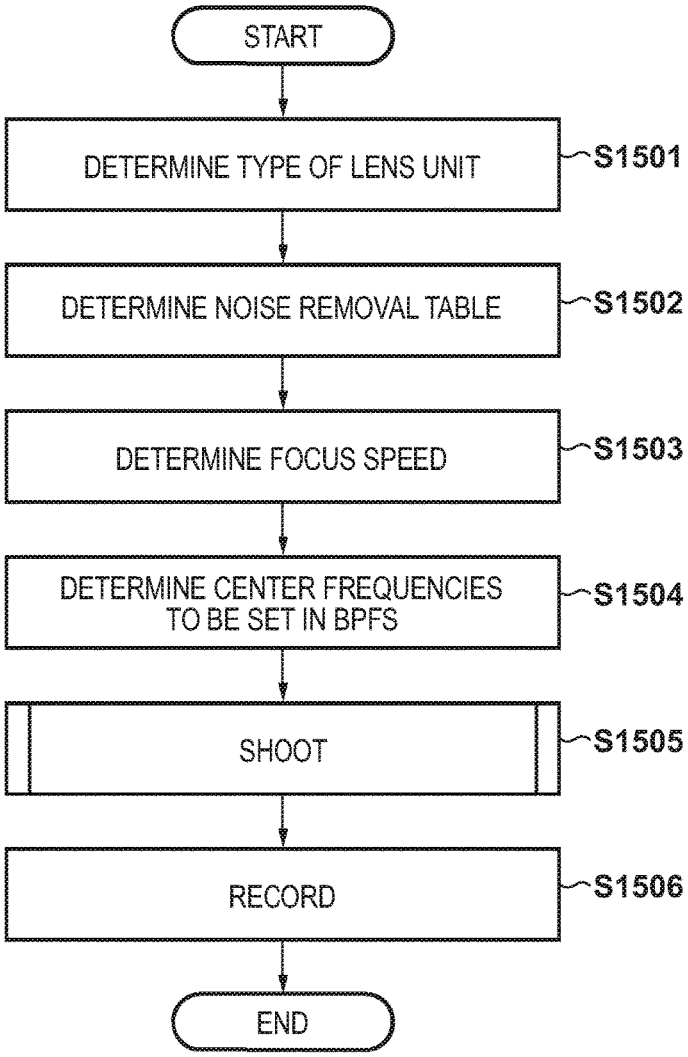
FIG. 10 is a flowchart showing a processing procedure of a system control circuit in the second embodiment.

FIG. 10 is a flowchart showing a processing procedure of the system control circuit 218 related to noise removal in this second embodiment. A program according to this flowchart is initially stored in the nonvolatile memory 220, and is read out to the memory 219 and executed by the system control unit 218.

First, in step S1501, the system control circuit 218 determines the type of the connected lens unit 238. Subsequently, in step S1502, the system control circuit 218 references the nonvolatile memory 220 based on the type of the lens unit 238, and selects a noise removal table for focusing.

Next, in step S1503, the system control circuit 218 determines a driving speed of a lens for focusing processing of the image capturing apparatus 201. This driving speed is determined according to the operation mode of the image capturing apparatus 201 that has been set by the user via an operation unit 223. In step S1504, the system control circuit 218 then reads out, from the selected table, the center frequencies f1, f2, and f3 for identifying driving noise bands corresponding to the driving speed that has been set, and sets the center frequencies f1, f2, and f3 for the three BPFs of each of the L-channel noise removing unit 1310 and the R-channel noise removing unit 1320.

After this, in the case where a shooting recording instruction made by the user is input via the operation unit 223, the system control circuit 218 controls various constituent elements so as to execute image capturing processing and sound collection processing, in step S1505. In sound collection processing, with the configuration described with reference to FIG. 8, audio data after driving noise removal for both L and R channels is acquired.

Subsequently, in step S1506, the system control circuit 218 records a moving image data file with sound to the storage medium 229.

As described above, according to this second embodiment, by reading out and setting a parameter of a frequency band for detecting driving noise unique to the lens unit 238 before driving the lens unit 238, the convergence speed of adaptive processing can be improved, and it is possible to perform noise removal in which propagation property difference depending on a driving unit is absorbed. In addition, in the embodiments, description has been given in which driving noise is made by driving of a focusing lens, but the driving noise may be noise made by driving of a zoom lens, or may be both.

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2017-157616 and 2017-157617, both filed Aug. 17, 2017, which are hereby incorporated by reference herein in their entirety.

What is claimed is:

1. An audio processing apparatus, comprising:

a driving unit;

a first microphone whose main acquisition target is sound from outside of the apparatus;

a second microphone whose main acquisition target is driving noise from the driving unit, compared with the first microphone; and a noise removing unit configured to generate two-channel audio data in which driving noise made by the driving unit has been reduced, based on a difference between time-series audio data acquired by the first microphone and time-series audio data acquired by the second microphone, wherein the noise removing unit includes:

a determination unit configured to determine whether or not the driving noise occurred based on the difference between time-series audio data acquired by the first microphone and time-series audio data acquired by the second microphone, a correlation processing unit configured to obtain a correlation value between phases of time-series audio data acquired by the first microphone and time-series audio data acquired by the second microphone in a case where the determination unit determines that the driving noise occurred, a generation unit configured to generate time-series audio data for which an error of an incident angle of sound from the outside to the first microphone and the second microphone was determined to exceed a preset threshold, out of time-series audio data acquired by the first microphone and time-series audio data acquired by the second microphone, based on the correlation value, a first adaptive filter configured to receive inputs of time-series audio data acquired by the first microphone and time-series audio data corresponding to the first microphone and generated by the generation unit, perform adaptive filter processing, and generate audio data of one channel of stereo, and a second adaptive filter configured to receive inputs of time-series audio data acquired by the second microphone and time-series audio data corresponding to the second microphone and generated by the generation unit, perform adaptive filter processing, and generate audio data of the other channel of stereo.

2. The apparatus according to claim 1, wherein the determination unit determines that time-series audio data acquired by the first microphone includes driving noise in a case where time-series audio data acquired by the second microphone is larger than a preset threshold.

3. The apparatus according to claim 1, wherein letting that time-series audio data from the first microphone and time-series audio data from the second microphone that have been acquired from the determination unit be M_x[t] and S_x[t], and $$\varphi_{ms} = \frac{\sum_{j=1}^{M} \mathrm{M_x}[t] \cdot \mathrm{S_x}[t+j]}{M} \quad (j = 0, 1, 2, \ldots, M),$$

the correlation processing unit determines M at which φms is positive and maximum, as a correlation value.

4. The apparatus according to claim 1, wherein the first microphone is a microphone whose main target is sound propagated from outside of the apparatus via a first opening portion provided at a predetermined position of a case of the audio processing apparatus, the second microphone is a microphone that converts sound that enters the apparatus via a second opening portion whose area is smaller than that of the first opening portion, into an electrical signal, and a volume of a space between the second microphone and the second opening portion is larger than a volume of space between the first microphone and the first opening portion in order to allow driving noise from the driving unit of the audio processing apparatus to be propagated to the second microphone.

5. The apparatus according to claim 1, wherein an image capturing unit is provided between the first microphone and the second microphone.

6. A control method of an audio processing apparatus that includes a driving unit, a first microphone whose main acquisition target is sound from outside of the apparatus, and a second microphone whose main acquisition target is driving noise from the driving unit, compared with the first microphone, the method comprising:

removing noise so as to generate two-channel audio data in which driving noise made by the driving unit has been reduced, based on a difference between time-series audio data acquired by the first microphone and time-series audio data acquired by the second microphone, wherein the removing includes:

determining whether or not the driving noise occurred based on the difference between time-series audio data acquired by the first microphone and time-series audio data acquired by the second microphone, obtaining a correlation value between phases of time-series audio data acquired by the first microphone and time-series audio data acquired by the second microphone in a case where it is determined that the driving noise occurred in this determining, generating time-series audio data for which an error of an incident angle of sound from the outside to the first microphone and the second microphone was determined to exceed a preset threshold, out of time-series audio data acquired by the first microphone and time-series audio data acquired by the second microphone, based on the obtained correlation value, receiving inputs of time-series audio data acquired by the first microphone and time-series audio data corresponding to the first microphone and generated in the generating, performing adaptive filter processing, and generating audio data of one channel of stereo, and receiving inputs of time-series audio data acquired by the second microphone and time-series audio data corresponding to the second microphone and generated in the generating, performing adaptive filter processing, and generating audio data of the other channel of stereo.

7. A non-transitory computer-readable storage medium that stores a program of steps of a noise removing method that is read out and executed by a processor in an audio processing apparatus that includes a driving unit, a first microphone whose main acquisition target is sound from outside of the apparatus, and a second microphone whose main acquisition target is driving noise from the driving unit, compared with the first microphone, the method comprising:

removing noise so as to generate two-channel audio data in which driving noise made by the driving unit has been reduced, based on a difference between time-series audio data acquired by the first microphone and time-series audio data acquired by the second microphone, wherein the removing includes:

determining whether or not the driving noise occurred based on the difference between time-series audio data acquired by the first microphone and time-series audio data acquired by the second microphone, obtaining a correlation value between phases of time-series audio data acquired by the first microphone and time-series audio data acquired by the second microphone in a case where it is determined that the driving noise occurred in this determining, generating time-series audio data for which an error of an incident angle of sound from the outside to the first microphone and the second microphone was determined to exceed a preset threshold, out of time-series audio data acquired by the first microphone and time-series audio data acquired by the second microphone, based on the obtained correlation value, receiving inputs of time-series audio data acquired by the first microphone and time-series audio data corresponding to the first microphone and generated in the generating, performing adaptive filter processing, and generating audio data of one channel of stereo, and receiving inputs of time-series audio data acquired by the second microphone and time-series audio data corresponding to the second microphone and generated in the generating, performing adaptive filter processing, and generating audio data of the other channel of stereo.

* * * * *